United States Patent [19]

Tran et al.

[11] 4,160,189

[45] Jul. 3, 1979

[54] ACCELERATING STRUCTURE FOR A LINEAR CHARGED PARTICLE ACCELERATOR OPERATING IN THE STANDING-WAVE MODE

[75] Inventors: Duc Tien Tran; Dominique Tronc, both of Buc, France

[73] Assignee: C.G.R.-Mev, Buc, France

[21] Appl. No.: 891,058

[22] Filed: Mar. 28, 1978

[30] Foreign Application Priority Data

Mar. 31, 1977 [FR] France ..... 77 09809

[51] Int. Cl.[2] ..... H01J 25/10

[52] U.S. Cl. ..... 315/5.41; 315/5.42

[58] Field of Search ..... 315/5.41, 5.42

[56] References Cited

U.S. PATENT DOCUMENTS 2,813,996 11/1957 Chodorow ..... 315/5.42

2,920,228 1/1960 Ginzton ..... 315/5.41 X 2,993,141 7/1961 Post ..... 315/5.42

*Primary Examiner*—Saxfield Chatmon, Jr.

*Attorney, Agent, or Firm*—Cushman, Darby & Cushman

[57] ABSTRACT

A compact accelerating structure comprises an accelerating section and a complementary section which may be used as a bunching section and/or a preaccelerating section, this complementary section being constituted by a first cavity and a second cavity joined to one another and electromagnetically coupled with one another in a direct manner, the second cavity, which is adjacent to the accelerating section, having a length L and being electromagnetically coupled to the first cavity and to the accelerating section in such a manner that the electromagnetic accelerating field is zero in this second cavity.

14 Claims, 4 Drawing Figures

ACCELERATING STRUCTURE FOR A LINEAR CHARGED PARTICLE ACCELERATOR OPERATING IN THE STANDING-WAVE MODE

FIELD OF THE INVENTION

The present invention relates to a compact structure for accelerating charged particles. Charged particle accelerators generally comprise a prebunching or preaccelerating structure associated with the accelerating structure.

DISCUSSION OF THE PRIOR ART

Now, known prebunching or preaccelerating structures (cf. for example Applicants' Pat. Patent No. 3,784,873) have electrical and dimensional characteristics such that they cannot be used for accelerators operating at high frequencies (C-band or X-band for example) because in this case the distance separating the interaction spaces becomes very small.

The accelerating structure according to the present invention may be used with advantage for accelerators such as these.

SUMMARY OF THE INVENTION

According to the invention, an accelerating structure for a charged particle accelerator comprises at least an accelerating section formed by a series of resonant cavities operating in the stationary-wave mode and a complementary cavity section situated upstream said accelerating structure in the path of the beam, said complementary section being electromagnetically coupled with the accelerating section, the cavities of the accelerating section, which comprise axial orifices for the passage of the beam being electromagnetically coupled with one another, said accelerating structure being provided with means for injecting a hyperfrequency signal into the accelerating structure, said complementary section comprising at least a first resonant cavity and a second resonant cavity electromagnetically coupled with one another, the second resonant cavity having, which is adjacent to said first cavity a length L such that the distance D separating the interaction spaces of the first cavity of the complementary section and of the first cavity of the accelerating section is equal to:

$$D=[2k+(n/2)]\pi\beta\lambda_o \quad (1)$$

where n and k are integers at least equal to 1, $\beta$ is the mean reduced velocity v/c of the charged particles, $\lambda_o$ is the freespace wavelength of the H.F. signal injected into the accelerating structure, means being provided for electromagnetically coupling said second cavity of said complementary section to said first cavity of the complementary section and to the first cavity of said accelerating section in such a manner that the H-F accelerating field is zero in second cavity of said complementary section.

BRIEF DESCRIPTION OF THE DRAWINGS

For a better understanding of the invention and to show how the same may be carried into effect, reference will be made to the drawings, given solely by way of example which accompany the following description and wherein.

DETAILED DESCRIPTION

Figure 1:
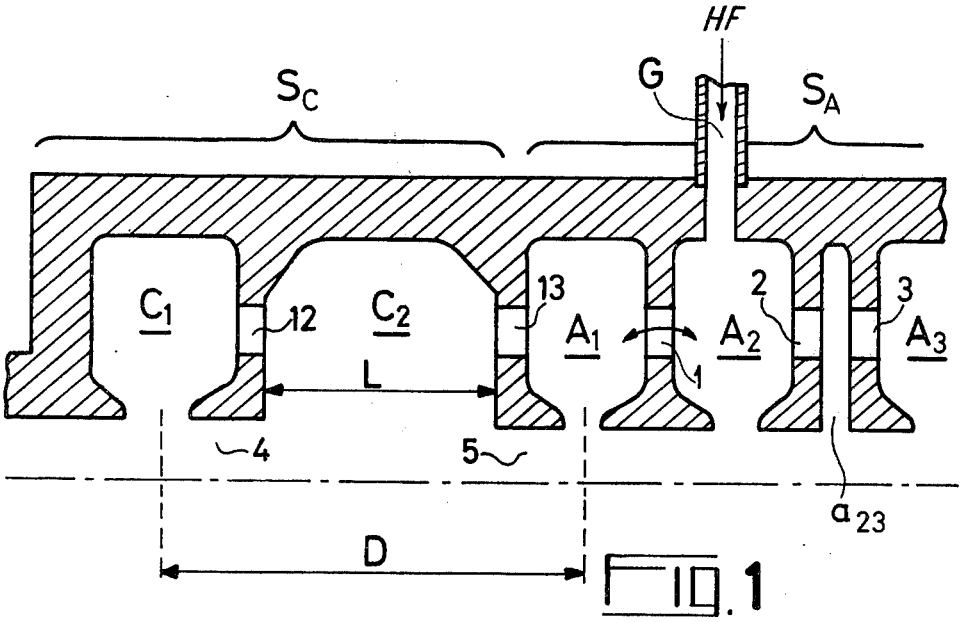
FIGS. 1 to 4 diagrammatically illustrate four examples of embodiment of accelerating structures according to the invention.

FIG. 1 shows a first example of embodiment of an accelerating structure according to the invention comprising an accelerating section $S_A$ of the triperiodic type, such as described by Applicants in the U.S. Pat. No. 3,953,758 for example and formed by a series of cavities $A_1$, $A_2$. . . electromagnetically coupled with one another either by means of a coupling hole 1 or by means of a coupling cavity $a_{23}$ provided with coupling holes 2 and 3. A hyperfrequency signal emitted by a hyperfrequency generator (not shown) is injected for example into the cavity $A_2$ by means of a waveguide. G. Associated with this accelerating section $S_A$ is a complementary section $S_C$ (which may be a bunching section or a preaccelerating section). This complementary section $S_C$ is formed by a first resonant cavity $C_1$ and a second resonant cavity $C_2$ electromagnetically coupled with one another by means of a coupling hole 12 and respectively provided at their centre with orifices 4,5. This cavity $C_2$, which is electromagnetically coupled with the first cavity $A_1$ of the accelerating section, has a length L such that the distance D seperating the interaction spaces of the cavity $C_1$ and the cavity $A_1$ is equal to:

$$D=[2k+(n/2)]\pi\beta\lambda_o \quad (1)$$

where k and n are integers equal to or greater than 1, $\beta$ is the mean reduced velocity v/c of the charged particles and $\lambda_o$ is the free-space wavelength of the H.F. signal injected into the accelerating structure $S_A$. Cavity $C_2$ is electromagnetically coupled to the cavity $C_1$ and to the cavity $A_1$ in such a manner that the H.F accelerating field is zero in this cavity $C_2$ which thus has the characteristics of a drift space.

In the example shown in FIG. 1, the cavities $C_2$ and $A_1$ are magnetically coupled by means of a coupling hole 13.

If, in equation (1), n is an odd number (for example 1), the cavity $C_2$ is a "bunching" cavity enabling the particles to be bunched before they enter the accelerating section $S_A$. If n is an even number (for example 2), the cavity $C_2$ is a "preaccelerating" cavity.

In the accelerating structure of the triperiodic type, formed by n groups of three resonant cavities such as shown in FIG. 1, the first cavity $C_1$ of the complementary section $S_C$ operates at the frequency $f_1=f\pm\Delta f$, where f is the operating frequency of the cavity $A_1$.

Figure 2:
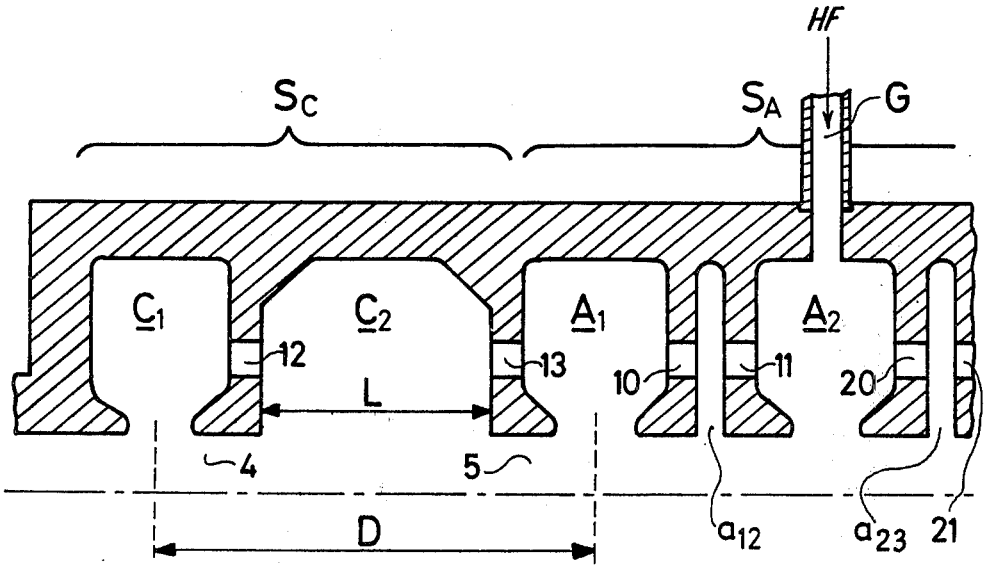

When the accelerating structure is of the biperiodic type, i.e. formed by n groups of two cavities as shown in FIG. 2, the accelerating cavities $A_1$, $A_2$. . . are magnetically coupled with one another by means of coupling holes 10, 11 and 20, 21 and the operating frequency of the cavity $C_1$ is adjusted to a frequency substantially equal to the operating frequency f of the cavity $A_1$.

Figure 3:
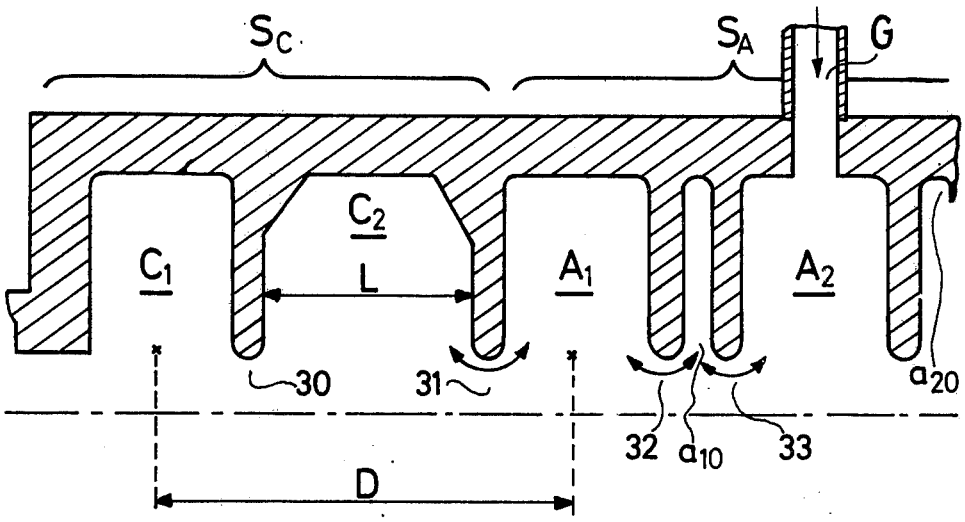

FIG. 3 shows a biperiodic structure according to the invention of which the accelerating cavities $A_1$, $A_2$. . . are coupled by means of coupling cavities $a_{10}$, $a_{10}$. . . , these coupling cavities being electrically coupled with the two cavities adjacent to them by means of orifices 32, 33 for the passage of the beam of particles. In this example of embodiment, the cavities $C_1$ and $C_2$ on the one hand and the cavities $C_2$, $A_1$ on the other hand are electrically coupled with one another by means of orifices 30 and 31 for the passage of the beam of particles.

Figure 4:
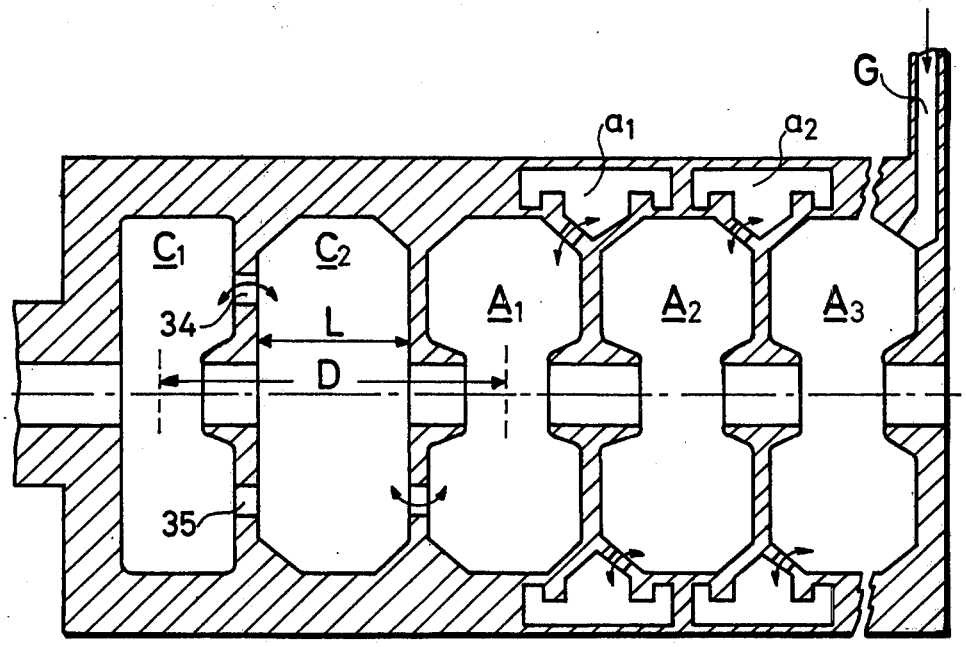

The example of embodiment shown in FIG. 4 is a triperiodic accelerating structure of which the accelerating cavities $A_1$, $A_2$ and $A_2$, $A_3$ are respectively coupled with one another by means of annular cavities $a_1$, $a_2$, as described by Applicants in the U.S. Pat. No. 3,906,300. The cavities $C_1$ and $C_2$ of the complementary section $S_C$ are magnetically coupled with one another by means of two coupling holes 34 and 35 disposed at 180° from one another.

What we claim is:

1. An accelerating structure for a linear charged particle accelerator comprising at least an accelerating section formed by a series of resonant cavities operating in the stationary-wave mode; a complementary cavity section disposed upstream said accelerating structure in the path of said particles, said complementary cavity section being joined to and electromagnetically coupled with said accelerating section, said cavities of the accelerating section, which comprise axial orifices for the passage of the beam, being electromagnetically coupled with one another; and means for injecting a hyperfrequency signal into said accelerating sections; said complementary section comprising at least a first resonant cavity and a second resonant cavity electromagnetically coupled with one another, said second resonant cavity having a length L such that the distance D separating the interaction spaces of the first cavity of the complementary section and of the first cavity of the accelerating section is equal to:

$$D=(2k+n/2)]\pi\beta\lambda_o \quad (1)$$

when n and k are integers at least equal to 1, $\beta$ is the mean reduced velocity v/c of the charged particles, and $\lambda_o$ is the free-space wavelength of the H.F. signal injected into the accelerating structure, said second cavity of said complementary section, which has predetermined dimensions, being electromagnetically coupled with said first cavity of the complementary section and said first cavity of the accelerating section in such a manner that the H.F accelerating field is zero in said second cavity of the complementary section.

2. An accelerating structure as claimed in claim 1, where n is an odd number, and said second cavity is a bunching cavity for the charged particles.

3. An accelerating structure as claimed in claim 1, where n is an even number and said second cavity is a preaccelerating cavity for the charged particles.

4. An accelerating structure as claimed in claim 1, wherein said accelerating structure is of the triperiodic type and the operating frequency of the first cavity of the complementary section is equal to $f+\Delta f$, f being the operating frequency of the first cavity of the accelerating section.

5. An accelerating structure as claimed in claim 1, wherein said accelerating structure is of the biperiodic type and the operating frequency of the first cavity of the complementary section is equal to the operating frequency of the first cavity of the accelerating section.

6. An accelerating structure as claimed in claim 5, wherein said first cavity of the complementary section has substantially the dimensions of the first cavity of said accelerating structure, said second cavity of the complementary section being electromagnetically coupled with said first cavity of the accelerating section and with said second cavity of the complementary section by means of coupling holes, the position and the dimensions of said coupling holes being such that the accelerating component of the H.F. signal is zero in the second cavity of the complementary section.

7. An accelerating structure as claimed in claim 4, wherein said cavities of the accelerating section are electrically coupled with one another by means of said central orifice.

8. An accelerating structure as claimed in claim 5, wherein said cavities of said accelerating section are electrically coupled with one another by means of said central orifice.

9. An accelerating structure as claimed in claim 4, wherein said cavities of said accelerating section are magnetically coupled with one another.

10. An accelerating structure as claimed in claim 5, wherein said cavities of the accelerating section are magnetically coupled with one another.

11. An accelerating structure as claimed in claim 9, wherein said magnetic coupling is obtained by means of coupling holes formed in the wall of two consecutive accelerating cavities.

12. An accelerating structure as claimed in claim 9, wherein said magnetic coupling is obtained by means of annular cavities.

13. An accelerating structure as claimed in claim 10, wherein said magnetic coupling is obtained by means of coupling holes formed in the wall of two consecutive accelerating cavities.

14. An accelerating structure as claimed in claim 10, wherein said magnetic coupling is obtained by means of annular cavities.

* * * * *